US009319803B2

(12) United States Patent
Gozen

(10) Patent No.: US 9,319,803 B2
(45) Date of Patent: Apr. 19, 2016

(54) HEARING AID AND METHOD FOR CONTROLLING THE SAME

(75) Inventor: Shinya Gozen, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 406 days.

(21) Appl. No.: 13/583,786

(22) PCT Filed: Jan. 16, 2012

(86) PCT No.: PCT/JP2012/000223

§ 371 (c)(1),
(2), (4) Date: Sep. 10, 2012

(87) PCT Pub. No.: WO2012/098856

PCT Pub. Date: Jul. 26, 2012

(65) Prior Publication Data

US 2013/0022224 A1 Jan. 24, 2013

(30) Foreign Application Priority Data

Jan. 17, 2011 (JP) ..... 2011-006585

(51) Int. Cl.
*H04R 25/00* (2006.01)

(52) U.S. Cl.
CPC ..... *H04R 25/356* (2013.01); *H04R 25/00* (2013.01); *H04R 2225/41* (2013.01)

(58) Field of Classification Search
CPC .... H03G 3/345; H04B 1/1027; H04R 25/356; H04R 25/502
USPC ..... 381/312, 317, 318, 320, 321, 93
See application file for complete search history.

(56) References Cited

U.S. PATENT DOCUMENTS 5,091,952 A * 2/1992 Williamson et al. ..... 381/318
6,049,618 A * 4/2000 Saltykov ..... 381/321

(Continued)

FOREIGN PATENT DOCUMENTS

JP 58-194598 12/1983
JP 1-146413 6/1989

(Continued)

OTHER PUBLICATIONS

International Search Report issued Mar. 13, 2012 in corresponding International Application No. PCT/JP2012/000223.

(Continued)

*Primary Examiner* — Davetta W Goins
*Assistant Examiner* — Phylesha Dabney
(74) *Attorney, Agent, or Firm* — Wenderoth, Lind & Ponack, L.L.P.

(57) ABSTRACT

When hearing-aid processing and predetermined-sound suppression processing are performed, in order to reduce an increase in delay of an output sound in response to an input sound greater than a case where only the hearing-aid processing is performed, a hearing aid includes: a hearing-aid processing unit configured to amplify a first acoustic signal received by a microphone, according to an ability of a user to hear sound in each of frequencies, to produce a second acoustic signal; a predetermined-sound detection unit configured to detect a predetermined sound included in the first acoustic signal, and to produce a control signal indicating generation timing of the predetermined sound; and a predetermined-sound suppression unit configured to suppress the second acoustic signal produced in the hearing-aid processing unit at the generation timing of the predetermined-sound indicated by the control signal produced in the predetermined-sound detection unit.

11 Claims, 9 Drawing Sheets

(56) References Cited

U.S. PATENT DOCUMENTS

| | | | | |
|---|---|---|---|---|
| 7,929,933 | B2 * | 4/2011 | Gozen | 455/226.2 |
| 8,050,646 | B2 * | 11/2011 | Gozen | 455/296 |
| 8,391,524 | B2 * | 3/2013 | Gozen | 381/317 |
| 8,548,180 | B2 * | 10/2013 | Takagi et al. | 381/317 |
| 2008/0240458 | A1 | 10/2008 | Goldstein et al. | |
| 2008/0287086 | A1 * | 11/2008 | Gozen | 455/311 |
| 2009/0274251 | A1 * | 11/2009 | Gozen | 375/346 |
| 2009/0296965 | A1 * | 12/2009 | Kojima | 381/312 |

FOREIGN PATENT DOCUMENTS

| | | |
|---|---|---|
| JP | 6-276599 | 9/1994 |
| JP | 8-163065 | 6/1996 |
| JP | 2000-278786 | 10/2000 |
| JP | 2002-507355 | 3/2002 |
| JP | 2011-135442 | 7/2011 |
| WO | 99/00896 | 1/1999 |
| WO | 2008/083315 | 7/2008 |
| WO | 2010/083879 | 7/2010 |

OTHER PUBLICATIONS

Office Action issued Jun. 3, 2015 in corresponding Chinese Application No. 201280000899.6 (with English translation of Search Report).

Extended European Search Report issued May 4, 2015 in corresponding European Application No. 12736534.4.

* cited by examiner

HEARING AID AND METHOD FOR CONTROLLING THE SAME

TECHNICAL FIELD

The present invention relates to hearing aids and methods for controlling the same, and particularly to a hearing aid capable of suppressing a predetermined sound, such as noise, which abruptly occurs, and a method for controlling the hearing aid.

BACKGROUND ART

Recently, the number of people who use a hearing aid (shown in FIG. 12) has increased with progress of an aging society. Typically, a hearing aid is a device which amplifies ambient sound and allows a user to hear the ambient sound. However, a noise and other sounds, such as, a sound generated when a door is opened or closed (hereinafter, referred to as "a predetermined sound"), are amplified in the same manner as a voice, resulting in an excessively large output sound, since amplitude of the predetermined sound drastically increases immediately after generation of the sound. This burdens and causes the user to feel uncomfortable.

In response to the above problem, a device is suggested in which a gain is controlled by detecting a transitional noise from the outside based on a value of ratio between an effective value and an absolute value in terms of input sound which is divided into blocks for respective predetermined time zones (for example, see Patent Literature 1), as shown in FIG. 10.

Furthermore, another conventional hearing aid is suggested in which a controlled gain is decreased in a relatively short time so as to prevent the excessively large output when an input-sound pressure or an output-sound pressure increases (for example, see Patent Literature 2), as shown in FIG. 11.

CITATION LIST

Patent Literature

[PTL 1] Japanese unexamined patent application publication No. 1-146413

[PTL 2] Japanese unexamined patent application publication (Translation of PCT application) No. 2002-507355

SUMMARY OF INVENTION

Technical Problem

However, the aforementioned conventional hearing aid requires a certain amount of time for detecting and suppressing a predetermined sound included in an acoustic signal. For suppressing the predetermined sound included in the acoustic signal, the predetermined sound included in the acoustic signal is first detected, and then, a control signal for suppressing the predetermined sound is produced. The control signal is produced behind the acoustic voice signal by a time period required for detecting the predetermined sound from the acoustic signal. In order to suppress the predetermined sound by the control signal, it is also necessary for the acoustic signal to be delayed by the time period required for detecting the predetermined sound. However, this increases the delay of the output acoustic signal (hereinafter, referred to as an "output sound") in response to an input acoustic signal (hereinafter, referred to as an "input sound"), when processing for suppressing the predetermined sound is performed along with processing for amplifying the acoustic signal (hearing-aid processing), in comparison with a case where only the hearing-aid processing is performed. Assuming that the acoustic signal is not delayed, an acoustic signal which includes the predetermined sound is output before the time period elapses which is required for the processing of detection and suppression of the predetermined sound. For obtaining an appropriate suppression effect, it can be said that a delay device which delays the acoustic signal before the suppression processing is performed is a necessary structural component.

Meanwhile, a main utilization purpose of the hearing aid is to assist conversation. For establishment of natural conversation, the delay of the output acoustic signal in response to the input acoustic signal in the hearing aid is desirably short.

In view of the above, when the hearing-aid processing and the predetermined-sound suppression processing are performed, it becomes an issue that the increase in the delay of the output sound in response to the input sound should be reduced greater than the case where only the hearing-aid processing is performed.

The present invention is made for solving the above problems, and an object of the present invention is to provide a hearing aid and a method for controlling the hearing aid, in which when the hearing-aid processing and the predetermined-sound suppression processing are performed, the increase in the delay of an output sound in response to an input sound is reduced greater than the case where only a hearing-aid processing is performed.

Solution to Problem

In order to solve the above problems, a hearing aid according to an embodiment of the present invention includes: a hearing-aid processing unit configured to amplify a first acoustic signal received by a microphone, according to an ability of a user to hear sound in each of a plurality of frequencies, to produce a second acoustic signal; a predetermined-sound detection unit configured to detect a predetermined sound which is included in the first acoustic signal and abruptly occurs, and to produce a control signal for suppressing the predetermined sound; and a predetermined-sound suppression unit configured to attenuate the second acoustic signal produced by the hearing-aid processing unit, based on the control signal produced by the predetermined-sound detection unit.

With this configuration, the predetermined sound included in an input sound can be detected in the predetermined-sound detection unit in parallel with performing the hearing-aid processing on the input sound in the hearing-aid processing unit, thereby to suppress the predetermined sound with respect to the acoustic signal output from the hearing-aid processing unit. In other words, the predetermined-sound detection processing in the predetermined-sound detection unit is completed within a time period for the hearing-aid processing in the hearing-aid processing unit. Accordingly, additional delay need not be inserted which corresponds to a time period required for detecting the predetermined sound included in the input sound when the hearing-aid processing and the predetermined-sound suppression processing are performed, unlike the case where only the hearing-aid processing is performed. Therefore, the increase in the delay of the output sound with respect to the input sound can be reduced.

It is desirable that the hearing aid further includes a delay unit configured to delay the control signal produced by the predetermined-sound detection unit by a time difference between a time required for processing in the hearing-aid processing unit and a time required for processing in the predetermined-sound detection unit.

With this configuration, when a time period required for the hearing-aid processing in the hearing-aid processing unit is longer than a time period required for the predetermined-sound suppression processing, the time difference can be compensated, and the predetermined sound can be suppressed without the time difference.

It is desirable that the hearing-aid processing unit includes: a frequency conversion unit configured to produce a spectrum signal which indicates a frequency component included in the first acoustic signal; a gain calculation unit configured to calculate, from the spectrum signal produced by the frequency conversion unit, a control gain which indicates, for each of the frequencies, an amount of amplification of the first acoustic signal, according to the ability of the user to hear sound in each of the frequencies; and a gain application unit configured to amplify the first acoustic signal using the control gain calculated by the gain calculation unit to produce the second acoustic signal.

With this configuration, the time period required for the predetermined-sound detection processing in the predetermined-sound detection unit is shorter than the time period required for the hearing-aid processing in the hearing-aid processing unit. Accordingly, additional delay need not be inserted, and the hearing-aid processing and the predetermined-sound detection processing can be completed during a time period equal to the time period required for the hearing-aid processing.

It is desirable that the predetermined-sound detection unit is configured to detect the predetermined sound included in the first acoustic signal from the spectrum signal.

With this configuration, the predetermined sound can be detected with a smaller calculation amount in the suppression-amount calculation unit in comparison with a case where the predetermined sound is directly detected from the first acoustic signal.

It is desirable that the predetermined-sound detection unit includes: a suppression-amount calculation unit configured to produce a plurality of control signals, each of which indicates a corresponding one of suppression amounts each of which is allocated to a corresponding one of a plurality of frequency components in the predetermined sound included in the first acoustic signal; and a first suppression-amount control unit configured to output (i) at least one of the control signals produced by the suppression-amount calculation unit to the predetermined-sound suppression unit, and (ii) at least one of the control signals to the gain calculation unit, and the gain calculation unit is configured to control the control gain calculated from the spectrum signal, using a calculation based on the control signals output from the first suppression-amount control unit.

With this configuration, the predetermined sound can be suppressed by the respective characteristics different from each other between the rise zone which is the time zone where the amplitude of the predetermined sound drastically varies and the subsequent zone which is the time zone after the rise zone until the predetermined sound is no longer observed. In other words, in the predetermined-sound suppression unit, the predetermined sound having the great amplitude is suppressed in the rise zone, while the predetermined sound is suppressed so as to be gradually distinguished in the subsequent zone. Accordingly, the predetermined sound can be suppressed without preventing the user from recognizing the circumstances, so that the user can naturally recognize the predetermined sound.

It is desirable the first suppression-amount control unit is configured to output, to the predetermined-sound suppression unit, at least one of the control signals which includes a control signal having a minimum suppression amount among the suppression amounts each of which is allocated to the corresponding one of the frequencies included in the control signals.

With this configuration, the predetermined sound included in the input sound can be substantially controlled by the predetermined-sound suppression unit.

It is desirable the first suppression-amount control unit is configured to output, to the predetermined-sound suppression unit, at least one of the control signals which includes a control signal having a maximum suppression amount among the suppression amounts each of which is allocated to the corresponding one of the frequencies included in the control signals.

With this configuration, as a result of the control of the predetermined sound included in the input sound in the predetermined-sound suppression unit, the predetermined sound can be avoided from being at a low volume that the user cannot recognize.

It is desirable that the suppression-amount calculation unit is configured to calculate the control signals each of which is used for suppressing the corresponding one of the frequency components included in a first frequency band in the predetermined sound included in the first acoustic signal, and the gain calculation unit is configured to control the control gain calculated from the spectrum signal included in the first frequency band, using the calculation based on the control signals output from the first suppression-amount control unit.

With this configuration, the frequency band (first frequency band) of the predetermined sound suppressed in the subsequent zone is coincident with the band where the hearing-aid processing control is performed, so that the predetermined sound can more naturally suppressed.

It is desirable that the predetermined-sound suppression unit is configured to suppress the predetermined sound in a rise zone which is a time zone where an amplitude of the predetermined sound drastically varies, and the gain calculation unit is configured to keep the control gain in the rise zone, and to control the control gain based on the control signal output from the first suppression-amount control unit in a subsequent zone which is a time zone after the rise zone until the predetermined sound is no longer observed.

With this configuration, the predetermined sound can be suppressed without being delayed in the rise zone, to thereby solve the discomfort and burden imposed on the user. In the subsequent zone, the predetermined sound can be suppressed in cooperation with the hearing-aid processing. Therefore, the user cannot be prevented from recognizing the circumstances.

It is desirable that the hearing aid further includes: a volume adjusting switch capable of adjusting an output volume of the hearing aid; and a variable gain control unit configured to set the output volume of the hearing aid in response to a volume adjustment amount adjusted by the volume adjusting switch, in which the predetermined-sound detection unit includes a second suppression-amount control unit configured to increase or decrease the control signal calculated by the suppression-amount calculation unit based on a difference between the output volume and a reference value, when the output volume of the hearing aid which is set by the variable gain control unit is lower than the reference value.

With this configuration, when the user listens to a sound at a low volume, the predetermined sound can be suppressed within a range which is not below the volume the user can recognize. On the other hand, when the user listens to the sound at a large volume, the predetermined sound can be controlled so as not to be extremely amplified by the hearing-aid processing.

It is preferable that the reference value is a value of the output volume when the volume adjusting switch indicates the maximum volume.

With this configuration, the output sound pressure of the suppressed predetermined sound can be made constant.

It is desirable that the hearing aid further includes a storage unit configured to record a history of the volume adjustment amount adjusted by the volume adjusting switch, in which the reference value is determined based on the history of the volume adjustment amount recorded in the storage unit.

With this configuration, the output sound pressure of the predetermined sound which the user listens to on a usual usage can be obtained from the history recorded in the storage unit. Even when the user listens to the sound at the low volume for any reason, the predetermined sound can be listened to by the user at the output volume same with that on the usual usage.

A method for controlling a hearing aid according to an embodiment of the present invention, includes: amplifying a first acoustic signal received by a microphone, according to an ability of a user to hear sound in each of a plurality of frequencies to produce a second acoustic signal; detecting a predetermined sound which is included in the first acoustic signal and abruptly occurs, and producing a control signal for suppressing the predetermined sound; and attenuating the second acoustic signal produced in the amplifying, based on the control signal produced in the detecting.

With this method, processing for delaying the acoustic signal is not necessary for compensating the time period required for detecting the predetermined sound, so that the delay property generated in the hearing-aid processing step can be kept to suppress the predetermined sound.

Advantageous Effects of Invention

According to the present invention, when hearing-aid processing and predetermined-sound suppression processing are performed, an increase in delay of an output sound in response to an input sound can be reduced greater than a case where only the hearing-aid processing is performed.

DESCRIPTION OF EMBODIMENTS

Hereinafter, embodiments of the present invention is described referring to drawings. It should be noted that the embodiments described below each represent a preferred embodiment of the present invention. A numeral value, a shape, a material, a component, an arrangement position and a connection condition of the components, a step, a flow of steps, and the like described in the embodiments are merely examples, and are not intended to limit the present invention. The present invention is limited only by the scope of the claims. Accordingly, the component, among the components in the following embodiments, which is not defined in an independent claim representing the broadest concept of the present invention is described as not being necessarily required for achieving the object of the present invention but constituting a more preferred embodiment. It should be noted that same signs are allocated to the same components, and description for the components may be omitted.

In the following description, a predetermined sound means a noise and so on in which an amplitude drastically increases immediately after the sound is generated. The predetermined sound is, for example, a sound generated when a door is opened or closed.

[Embodiment 1]

Figure 1:
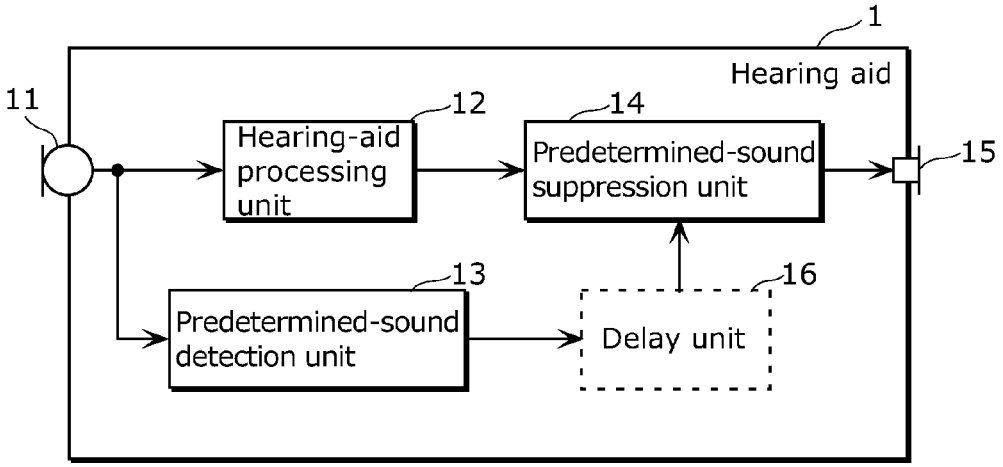
FIG. 1 is a functional block diagram which shows a hearing aid according to Embodiment 1.

FIG. 1 is a functional block diagram which shows a configuration of a hearing aid according to an embodiment of the present invention. A hearing aid 1 is described according to the embodiment of the present application in terms of configuration and operation thereof, with reference to FIG. 1.

The hearing aid 1 includes a microphone 11, a hearing-aid processing unit 12, a predetermined-sound detection unit 13, a predetermined-sound suppression unit 14, and a speaker 15. It should be noted that the hearing aid 1 may further include a delay unit 16.

The microphone 11 collects sounds generated outside the hearing aid 1 and produces an acoustic signal (a first acoustic signal).

The hearing-aid processing unit 12 amplifies the acoustic signal received by the microphone 11 according to an ability of a user to hear, to generate a new acoustic signal (a second acoustic signal).

The predetermined-sound detection unit 13 detects a predetermined sound included in the acoustic signal received by the microphone 11, and calculates a suppression amount which is to work as a magnification on suppressing the detected predetermined sound.

The predetermined-sound suppression unit 14 attenuates the acoustic signal amplified by the hearing-aid processing unit 12, using the suppression amount calculated in the predetermined-sound detection unit 13.

The speaker 15 outputs the acoustic signal attenuated in the predetermined-sound suppression unit 14, and enables the user to listen to the output acoustic signal.

The delay unit 16 delays a control signal including the suppression amount calculated in the predetermined-sound detection unit 13 to compensate delay of the acoustic signal by a time period required for processing (hearing-aid processing) of amplifying the acoustic signal in the hearing-aid processing unit 12. It should be noted that the delay unit 16 is not necessarily required. The hearing-aid processing requires a time period at a level of several msec, as described later. If the delay unit 16 is not provided in the hearing aid, the acoustic signal produced in the hearing-aid processing unit 12 achieves at the predetermined-sound suppression unit behind the control signal produced in the predetermined-sound detection unit. In the predetermined-sound suppression unit, however, an arrival timing of the control signal and a time period for performing the suppression are appropriately adjusted, to thereby suppress the predetermined sound even when the delay unit 16 is not provided in the hearing aid.

Along with recent high-functionalization of the hearing aid, a hearing-aid processing becomes available in which the acoustic signal is analyzed in respective frequency bands so as to be applicable to an auditory field of the user as needed. Hereinafter, the hearing aid according to the embodiment of the present invention performs the hearing-aid processing for each of the frequency bands.

Figure 2:
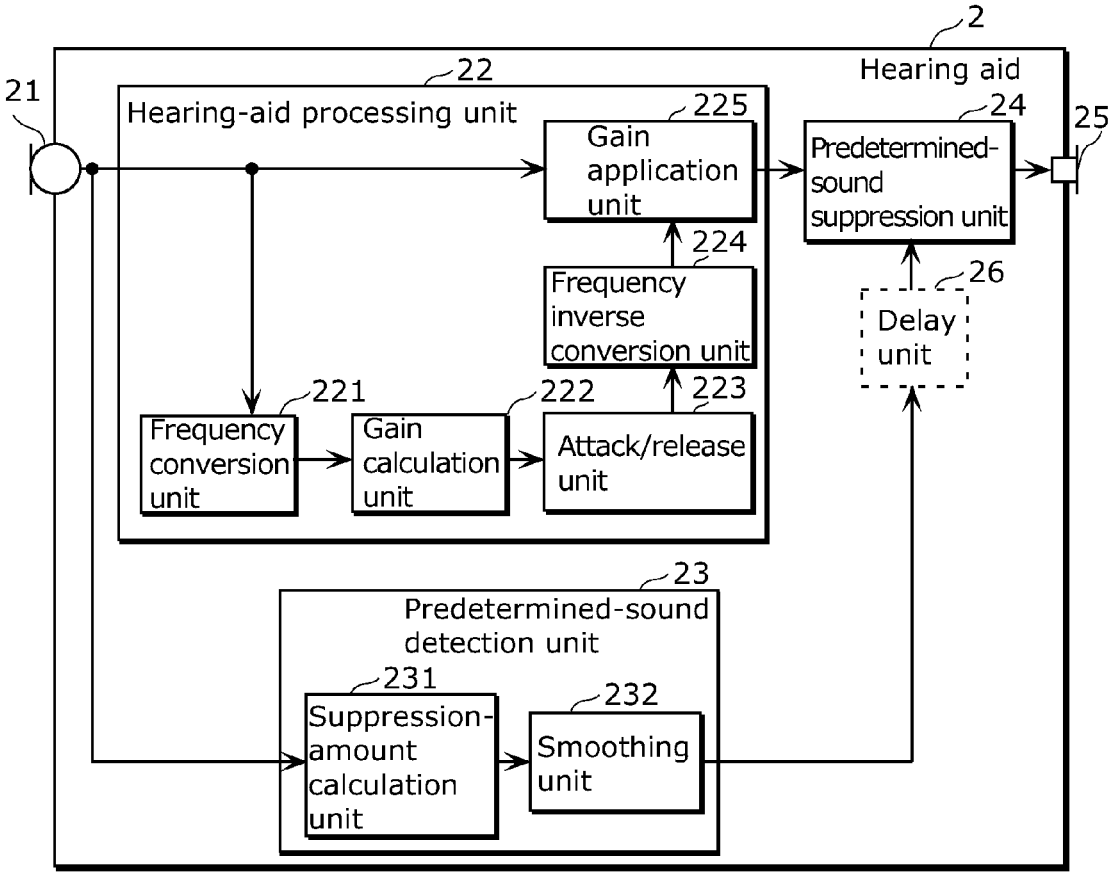
FIG. 2 is a functional block diagram which shows, in detail, a configuration of the hearing aid according to Embodiment 1.

FIG. 2 is a functional block diagram which shows, in detail, a configuration of the hearing aid according to Embodiment 1 of the present invention. A hearing aid 2 according to the embodiment of the present application is described in terms of configuration and operation thereof, with reference to FIG. 2.

The hearing aid 2 shown in FIG. 2 includes a microphone 21, a hearing-aid processing unit 22, a predetermined-sound detection unit 23, a predetermined-sound suppression unit 24, and a speaker 25. It should be noted that the hearing aid 2 may further include a delay unit 26.

The hearing-aid processing unit 22 includes a frequency conversion unit 221, a gain calculation unit 222, an attack/release unit 223, an inverse frequency conversion unit 224, and a gain application unit 225. In addition, the predetermined-sound detection unit 23 includes a suppression-amount calculation unit 231 and a smoothing unit 232.

The frequency conversion unit 221 in the hearing-aid processing unit 22 converts an acoustic signal received by the microphone 21 to a spectrum signal which indicates a frequency component of the received acoustic signal. The acoustic signal received by the microphone 21 is a time-domain signal, while the spectrum signal is a frequency-domain signal. As an example of processing of converting the time-domain signal to the frequency-domain signal, fast Fourier transformation (FFT) is available. The FFT is known as a typical technique of converting the time-domain signal to the frequency-domain signal.

The gain calculation unit 222 in the hearing-aid processing unit 22 calculates, from the frequency-converted spectrum signal, a signal power value for each of the bands which are subjected to control under the hearing-aid processing, and calculates a control gain according to the ability of the user to hear sound in each of the frequencies.

The attack/release unit 223 in the hearing-aid processing unit 22 monitors variation in time in the control gain calculated in the gain calculation unit 222. When the control gain is below a previous value (at a time of attack), the attack/release unit 223 quickly reacts to suppress the control gain. When the control gain is over the previous value (at a time of release), the attack/release unit 223 slowly reacts to recover the control gain. Here, the control gain is a positive value, and serves as a magnification used when the acoustic signal is amplified. Since a person skilled in the art can easily provide appropriate operation designs of the gain calculation unit 222 and the attack/release unit 223, detailed description in relation to the operation designs is omitted.

The inverse frequency conversion unit 224 in the hearing-aid processing unit 22 receives, as a frequency response, the control gain calculated in the gain calculation unit 222 and the attack/release unit 223, and operates inverse frequency conversion on the received control gain so as to calculate an impulse response, and then, to convert the impulse response to a filter coefficient.

The gain application unit 225 in the hearing-aid processing unit 22 applies the control gain calculated in the gain calculation unit 222 and the attack/release unit 223 to the acoustic signal received by the microphone 21. To be specific, the gain application unit 225 includes a filter to be operated in the time domain. The gain application unit 225 filters the received acoustic signal using a filter coefficient converted from the control gain in the inverse frequency conversion unit 224. Hereinafter, an operation for suppressing the predetermined sound is described in detail.

Figure 3:
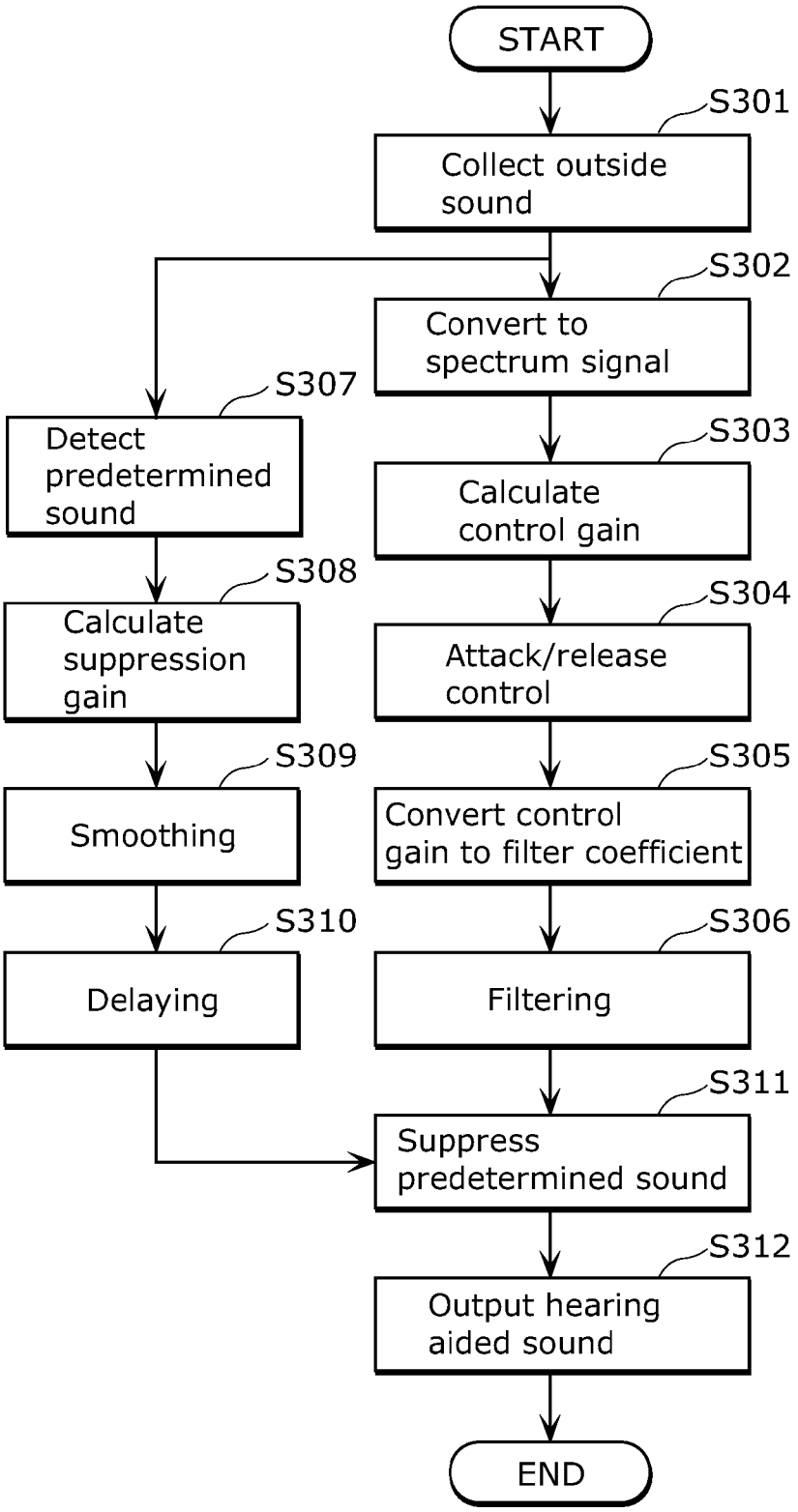
FIG. 3 is a flow chart which shows a control method in the hearing aid according to the present invention.

FIG. 3 is a flowchart which shows a predetermined-sound suppression method according to the present invention.

The microphone 21 collects the acoustic signal generated outside the hearing aid 2, and produces another acoustic signal (Step S301).

The frequency conversion unit 221 in the hearing-aid processing unit 22 converts the acoustic signal received by the microphone 21 to a spectrum signal in the frequency domain (Step S302).

The gain calculation unit 222 in the hearing-aid processing unit 22 calculates, from the frequency-converted spectrum signal, the signal power value for each of the bands which are subjected to the control under the hearing-aid processing, and also calculates the control gain according to the ability of the user to hear sound in each of the frequencies (Step S303).

The attack/release unit 223 in the hearing-aid processing unit 22 monitors the variation in time in the control gain calculated in the gain calculation unit 222. When the control gain is below the previous value (at the time of attack), the attack/release unit 223 quickly reacts, while when the control gain is over the previous value (at the time of release), the attack/release unit 223 slowly reacts, so as to smooth the control gain (Step S304).

The inverse frequency conversion unit 224 in the hearing-aid processing unit 22 receives the control gain calculated in the gain calculation unit 222 and the attack/release unit 223 as the frequency response, and operates the inverse frequency conversion on the received control gain so as to calculate an impulse response, and then to convert the impulse response to the filter coefficient (Step S305).

The gain application unit 225 in the hearing-aid processing unit 22 filters the acoustic signal received by the microphone 21, using the filter coefficient calculated in the inverse frequency conversion unit 224 (Step S306).

The suppression-amount calculation unit 231 in the predetermined-sound detection unit 23 receives, like the frequency conversion unit 221, the acoustic signal received by the microphone 21, and detects the predetermined sound included in the acoustic signal (Step S307). The suppression-amount calculation unit 231 calculates the suppression amount used for suppressing the detected predetermined sound (Step S308).

Here, according to human auditory property, variation in time in the acoustic signal is conceived by a time response at a level of 1 msec. Accordingly, a time period required for block processing performed in the predetermined-sound detection unit 23 which includes the suppression-amount calculation unit 231 is desirably longer than or equal to a sampling interval and shorter than or equal to a processing cycle of 1 msec. If the processing cycle is long, time is required for detecting the predetermined sound, causing the control signal (suppression amount) to be delayed. This requires the acoustic signal to be delayed for compensation of the delay of the achievement of the control signal to the predetermined-sound suppression unit.

The smoothing unit 232 in the predetermined-sound detection unit 23 operates smoothing according to variation in time in the suppression amount calculated in the suppression-amount calculation unit 231 (Step S309).

Here, a time constant of the smoothing processing performed in the smoothing unit 232 is desirably smaller than or equal to delay property which is generated in the hearing-aid processing unit 22. The time constant which exceeds the delay property which is generated in the hearing-aid processing unit 22 is used for performing the smoothing processing, causing the suppression amount smoothed in the smoothing unit 232 to be delayed behind the acoustic signal amplified in the hearing-aid processing unit 22. This requires the acoustic signal to be delayed for compensation of the delay of the achievement of the suppression amount to the predetermined-sound suppression unit.

The smoothing unit 232 monitors, like the attack/release unit 223, the variation in time in the suppression amount calculated in the suppression amount calculation unit 231 and performs the smoothing on the suppression-amount. To be specific, when the suppression amount is over the previous value (at the time of attack), the smoothing unit 232 quickly reacts to suppress the variation in time in the suppression amount to suppress the predetermined sound. Alternately, when the suppression amount is below the previous value (at the time of release), the smoothing unit 232 may slowly reacts to recover the gain. To be simpler, the smoothing unit 232 may react at a constant speed regardless of the variation in time in the suppression amount, and operate the smoothing on the suppression amount. The suppression amount calculated in the suppression amount calculation unit 231 is a positive value, and serves as the magnification used when the acoustic signal is attenuated. The larger a value of the suppression amount is, the greater the predetermined sound is suppressed in the predetermined-sound suppression unit 24. When the suppression amount is 0, the acoustic signal is not attenuated in the predetermined-sound suppression unit 24. In addition, the suppression amount never becomes a negative value.

Furthermore, when, for example, the hearing-aid processing unit 22 or another processing block which is not shown determines whether or not voice exists, the speed of reaction of the suppression amount may be changed according to the determination results in relation to the existence of the voice. For example, when it is determined that the voice does not exist and the suppression amount is below the previous value (at the time of release), the suppression amount slowly follows the variation in time in the suppression amount. On the other hand, when it is determined that the voice exists, the suppression amount may quickly follow the variation in time in the suppression amount to perform the smoothing on the suppression amount even when the suppression amount is below the previous value (at the time of release). This control quickly recovers the gain so that damage on the voice signal can be reduced, even when the suppression-amount calculation unit 231 erroneously calculates the suppression amount which is used to attenuate the voice signal.

The delay unit 26 delays the suppression amount calculated in the predetermined-sound detection unit 23, and compensates the delay of the acoustic signal by the time period required for amplifying the acoustic signal in the hearing-aid processing unit 22 (Step S310).

The predetermined-sound suppression unit 24 attenuates the acoustic signal amplified in the hearing-aid processing unit 22, using the suppression amount calculated in the predetermined-sound detection unit 23 and delayed in the delay unit 26 (step S311). The predetermined-sound suppression unit 24 outputs the attenuated acoustic signal from the speaker 26 so as to allow the user to listen to the output acoustic signal (Step S312).

With the above processing, the hearing aid 2 in the embodiment of the present invention can suppress the predetermined sound with keeping the delay property which is generated in the hearing-aid processing.

Figure 4:
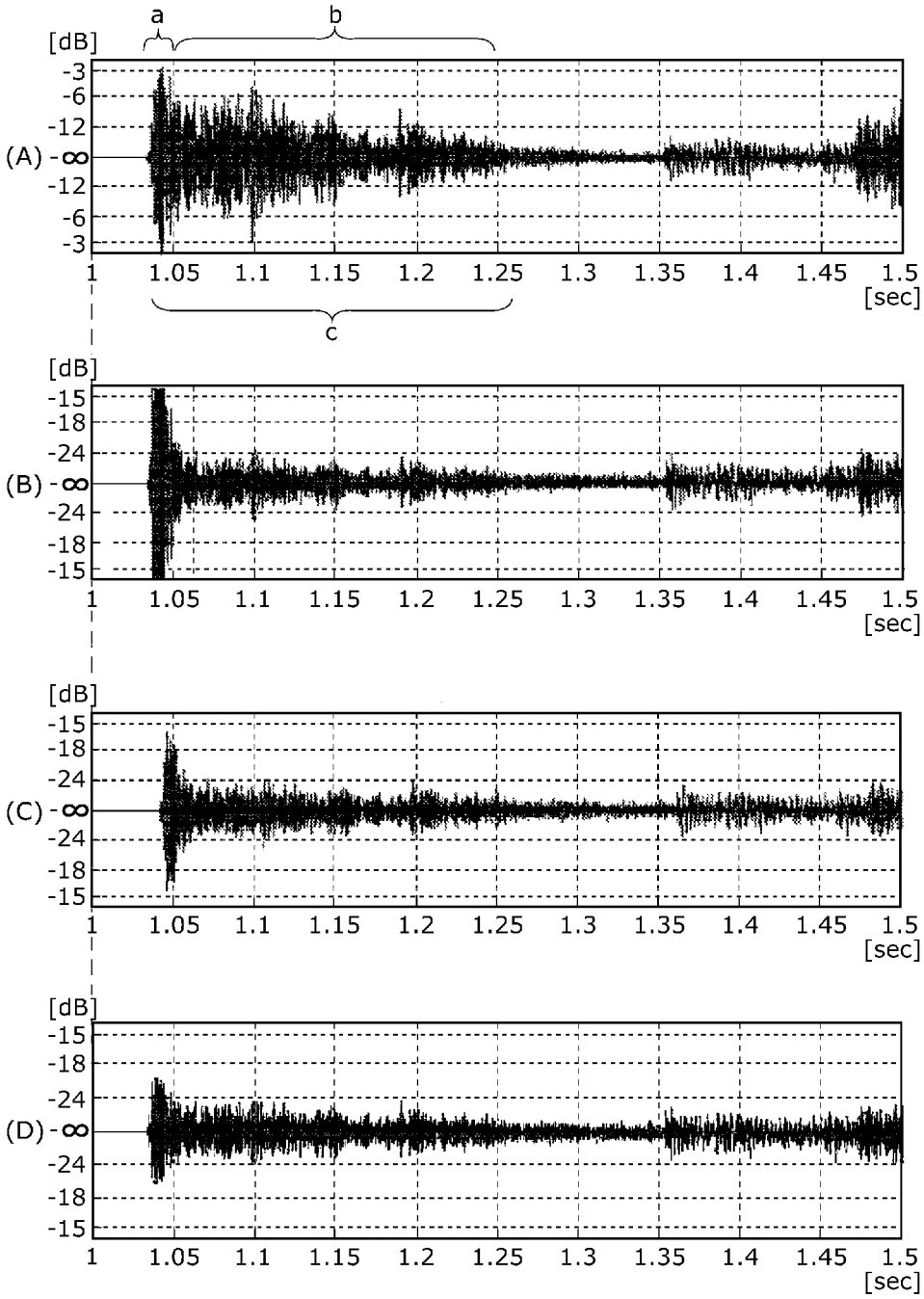
FIG. 4 is a diagram which shows an example of an output acoustic signal waveform according to Embodiment 1.

FIG. 4 is a diagram which shows an example of an output acoustic signal waveform according to Embodiment 1. Hereinafter, an effect obtained by the hearing aid 2 according to the embodiment of the present invention is described with reference to FIG. 4. It should be noted that a vertical axis and a horizontal axis respectively show an amplification and time, in each graph in FIG. 4. The predetermined sounds in relation to the waveforms shown in each graph in FIG. 4 are a noise and the like whose amplitude drastically increases immediately after the generation thereof, and then attenuates.

FIG. 4(A) shows an example of the output waveform obtained when only the hearing-aid processing is performed on a certain predetermined sound. FIG. 4(A) shows a zone c which indicates a time zone for a certain predetermined sound from generation to convergence thereof. The zone c includes a short time period immediately after the generation of the predetermined sound, which is a zone a where the amplitude drastically varies. The duration of the zone a is approximately 10 msec. Hereinafter, a time period which corresponds to the zone a in the typical predetermined sound is called a rise zone. Meanwhile, the predetermined sound includes a zone b which follows the zone a in the zone c. In the zone b, the amplitude gradually decreases after the increase in the amplitude in the zone a. Hereinafter, a time period which corresponds to the zone b in the typical predetermined sound is called a subsequent zone.

Figure 10:
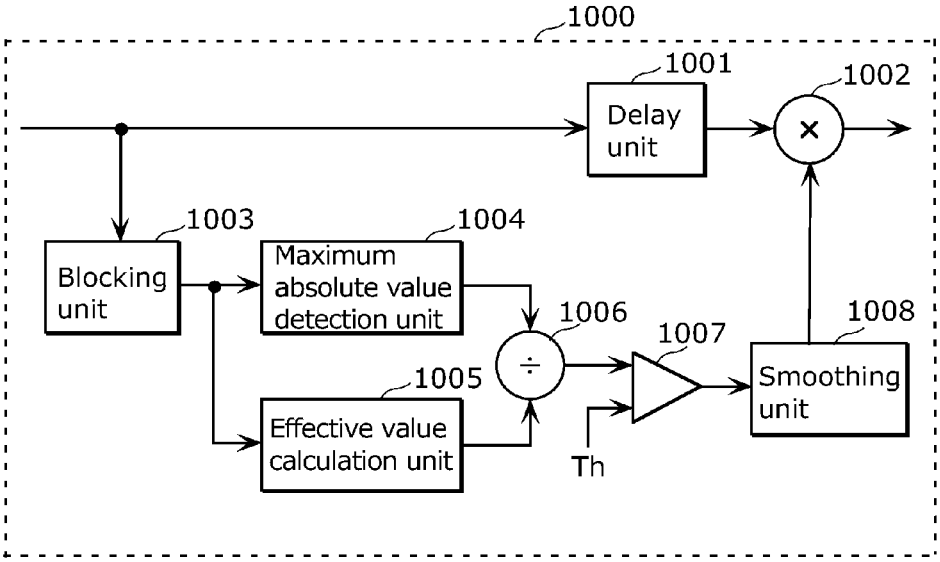
FIG. 10 is a block diagram which shows an acoustic apparatus according to Patent Literature 1.
Figure 11:
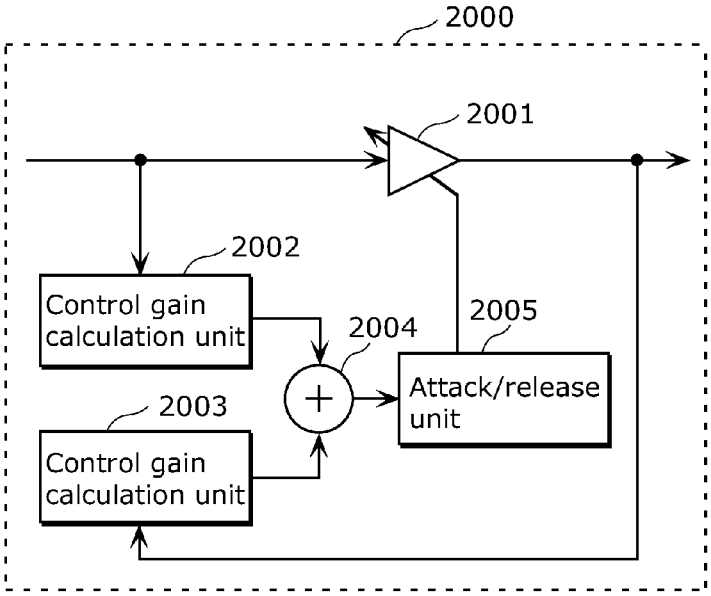
FIG. 11 is a block diagram which shows a hearing aid according to Patent Literature 2.
Figure 12:
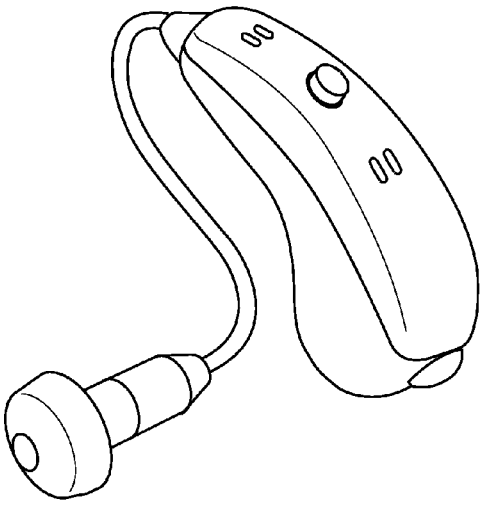
FIG. 12 is an appearance diagram of the hearing aid according to the present invention.

FIG. 4(B) shows an output waveform obtained by suppressing a certain predetermined sound which has been subjected to the hearing-aid processing without the delay unit 1001 being inserted, when a conventional device 1000 as shown in FIG. 10 is combined with the hearing aid. The predetermined sound has an extremely precipitous variation in the amplitude in the rise zone. Accordingly, when the acoustic signal is not delayed by the delay unit 1001, the acoustic signal including the predetermined sound is output before the suppression of the predetermined sound. Therefore, sufficient suppression effect cannot be obtained in the zone corresponding to the zone a in FIG. 4(A).

Meanwhile, FIG. 4(C) shows an output waveform obtained by suppressing a certain predetermined sound which has been subjected to the hearing-aid processing with the delay unit 1001 being provided. It should be noted that inserted delay in this case is 2 msec. Unlike the case shown in FIG. 4(B), the predetermined sound is suppressed in the entire zone c where the predetermined sound exists. However, the output waveform is delayed in 2 msec with respect to FIG. 4(A).

FIG. 4(D) shows an output waveform obtained by performing the hearing-aid processing and the predetermined-sound suppression processing in the hearing aid 2 according to the embodiments of the present invention. The predetermined sound can be suppressed in the entire zone c where the predetermined sound exists with the delay property shown in FIG. 4(A) being kept.

Typically, the hearing-aid processing unit 22 requires frequency resolution for controlling the voice signal, and has a certain level of the delay property. For example, when the hearing-aid processing unit 22 operates on 32 kHz-sampling which can sufficiently cover the voice band, a frequency analysis which is performed on 128 samples as one block is required for obtaining the frequency resolution of 250 Hz. Accordingly, even if processing blocks are half overlapped each other, the delay of 2 msec is generated. Furthermore, in a practical processing device, a delay generated during processing is added to the above.

Meanwhile, the predetermined-sound detection unit 23, according to the embodiments of the present invention, which controls the predetermined sound operates in the processing cycle shorter than or equal to 1 msec for appropriately detecting the predetermined sound as described above, and the delay property is smaller than that in the hearing-aid processing unit 22. Accordingly, the suppression amount calculated in the predetermined-sound detection unit 23 is never delayed behind the acoustic signal amplified in the hearing-aid processing unit 22. Conversely, since the suppression amount is antecedent to the acoustic signal, the acoustic signal need not be further delayed, so that the predetermined sound can be suppressed with the delay property generated in the hearing-aid processing 22 being kept.

As described above, it is not necessary for the hearing aid 2 according to the embodiment of the present invention to delay the acoustic signal for compensating the time period required for detecting the predetermined sound. Therefore, the hearing aid 2 according to the embodiment of the present invention can suppress the predetermined sound, with keeping the delay property generated in the hearing-aid processing.

It should be noted that the rise zone and the subsequent zone in relation to the predetermined sound designated in FIG. 4(A) are used for description, but do not limit the amplitude property and the frequency characteristics of the predetermined sound, and time division for the zone where the predetermined sound exists, which are efficient for the present invention.

In the embodiment of the present invention, a status related to presence or absence of a sound before the generation of the predetermined sound is not limited. Accordingly, even in a status where a sound other than the predetermined sound exists before the generation of the predetermined sound, the predetermined sound can be suppressed by a similar operation.

Figure 5:
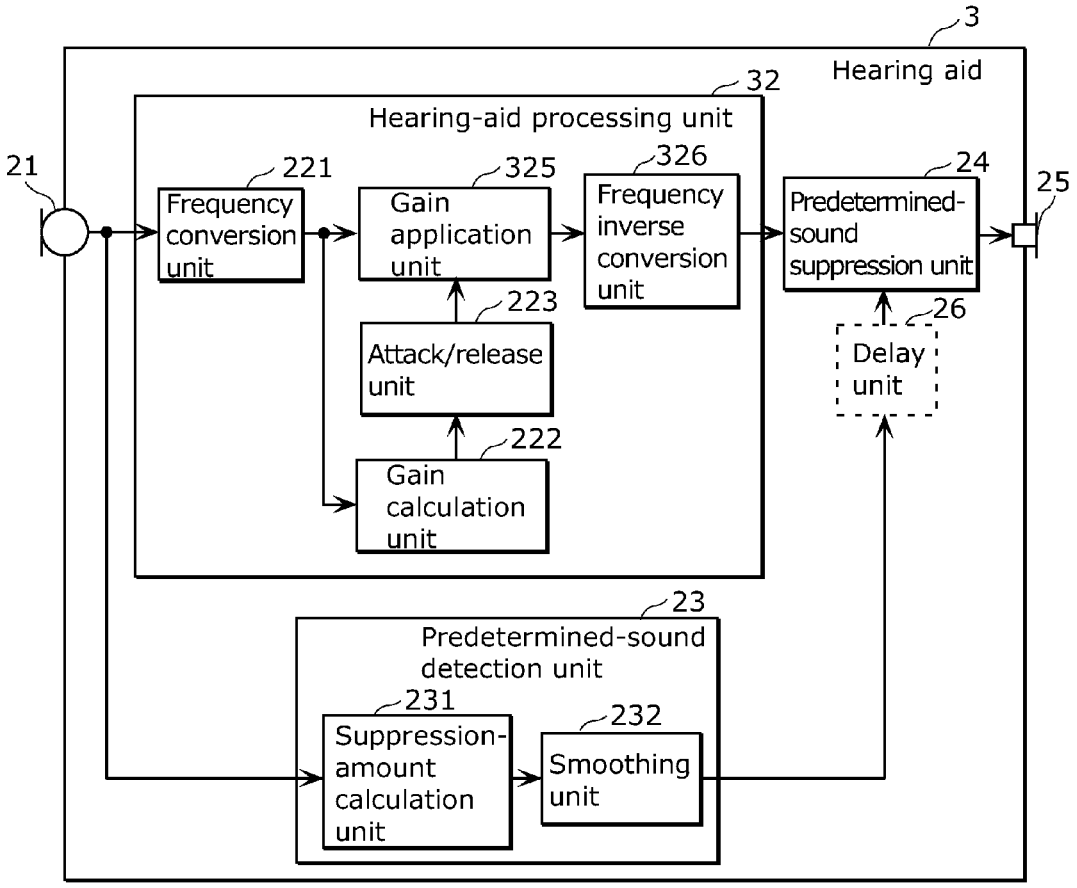
FIG. 5 is a block diagram which shows another aspect of the hearing aid according to Embodiment 1.

It should be noted that the hearing-aid processing unit 22 according to the embodiment of the present invention may have a configuration like the hearing-aid processing unit 32 shown in FIG. 5. FIG. 5 is a block diagram which shows another aspect of the hearing aid according to Embodiment 1 of the present invention. The hearing-aid processing unit 32 in a hearing-aid 3 shown in FIG. 5 includes a frequency conversion unit 221, a gain calculation unit 222, an attack/release unit 223, a gain application unit 325, and a inverse frequency conversion unit 326.

The frequency conversion unit 221, the gain calculation unit 222, and the attack/release unit 223 are the same with those provided in the hearing-aid processing unit 22.

The gain application unit 325 in the hearing-aid processing unit 32 applies a control gain calculated in the gain calculation unit 222 and the attack/release unit 223 to the acoustic signal received by the microphone 21. Specifically, the gain application unit 325 is configured by a multiplier operated in the frequency domain, and multiplies, by the control gain, the spectrum signal obtained by performing the frequency conversion on the received signal.

The inverse frequency conversion unit 326 in the hearing-aid processing unit 32 again converts the spectrum signal multiplied by the control gain in the gain application unit 325 to the acoustic signal in the time domain.

The hearing-aid processing unit in the hearing-aid according to the embodiments of the present invention is not limited to the above configuration, and as long as a unit has a hearing-aid processing configuration along with a frequency conversion unit, the unit is involved in the present invention. The configuration of the frequency conversion unit is not limited to the configuration employing FFT, and as long as a unit employs a method for extracting an amount of the frequency characteristics from a time domain signal, the unit is included in the present invention.

As described above, in the hearing aid according to the embodiment of the present invention, the predetermined sound included in an input sound can be detected in the predetermined-sound detection unit in parallel with the input sound being subjected to the hearing-aid processing in the hearing-aid processing unit, to thereby perform the predetermined-sound suppression processing on the acoustic signal output from the hearing-aid processing unit. In other words, the predetermined-sound detection processing in the predetermined-sound detection unit is completed within a processing time of the hearing-aid processing in the hearing-aid processing unit. Accordingly, when the hearing-aid processing and the predetermined-sound suppression processing are performed, additional delay need not be inserted which corresponds to a time period required for detecting the predetermined sound included in the input sound, unlike the case where only the hearing-aid processing is performed. Therefore, the increase in the delay of the output sound with respect to the input sound can be reduced.

Furthermore, when the time period required for the hearing-aid processing in the hearing-aid processing unit is longer than the time period required for the predetermined-sound suppression processing, the time difference can be compensated, so that the predetermined sound can be suppressed without time difference.

In addition, the time period required for the predetermined-sound detection processing in the predetermined-sound detection unit is shorter than the time period required for the hearing-aid processing in the hearing-aid processing unit. Accordingly, the hearing-aid processing and the predetermined-sound detection processing can be completed in the time period equal to the time period required for the hearing-aid processing without inserting the additional delay.

[Embodiment 2]

In Embodiment 2 of the present invention, processing for detecting the predetermined sound from the spectrum signal of the input sound is described. Hereinafter, the points same with those described in Embodiment 1 are omitted, and only a different point is described.

Figure 6:
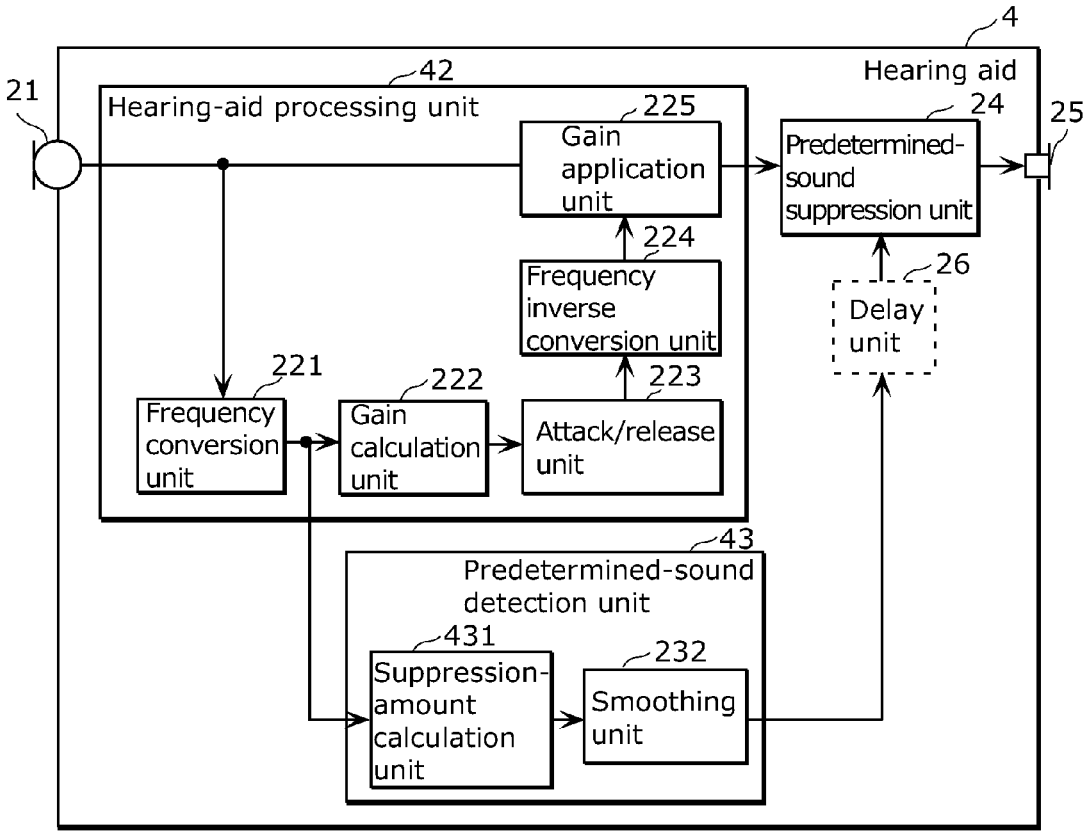
FIG. 6 is a block diagram which shows a hearing aid according to Embodiment 2.

FIG. 6 is a block diagram which shows a hearing aid 4 according to Embodiment 2 of the present invention. A hearing aid 4 according to Embodiment 2 of the present application is described in terms of configuration and operation thereof, with reference to FIG. 6. A basic configuration of the hearing aid 4 is the same with that of the hearing aid 2.

The hearing aid 4 includes a microphone 21, a hearing-aid processing unit 42, a predetermined-sound detection unit 43, a predetermined-sound suppression unit 24, and a speaker 25. It should be noted that the hearing aid 4 may further include the delay unit 26. Hereinafter, the description for the configuration same with that in the hearing aid 2 is omitted, and the hearing-aid processing unit 42 and the predetermined-sound detection unit 43 are described in terms of the configuration and the operation thereof.

The hearing-aid processing unit 42 outputs the spectrum signal calculated in the frequency conversion unit 221 to the predetermined-sound detection unit 43.

The predetermined-sound detection unit 43 includes the suppression-amount calculation unit 431 which receives the spectrum signal calculated in the frequency conversion unit 221 as an input.

The suppression-amount calculation unit 431 in the predetermined-sound detection unit 43 receives the spectrum signal calculated in the frequency conversion unit 221 as an input, and detects the predetermined sound included in the acoustic signal received by the microphone 21. The suppression-amount calculation unit 431 calculates the suppression amount which is used for suppressing the detected predetermined sound.

With this configuration, in the hearing aid 4 according to Embodiment 2, a part of components of the suppression-amount calculation unit 231 in the hearing aid 2 can be shared with the frequency conversion unit 221 in the hearing-aid processing unit 42. Accordingly, the hearing aid 4 can achieve reduction in a calculation amount in the suppression-amount calculation unit 231 by the suppression-amount calculation unit 431.

As described above, in the hearing aid according to an embodiment of the present invention, the predetermined sound can be detected with a smaller calculation amount in the suppression-amount calculation unit in comparison with a case where the predetermined sound is directly detected from the first acoustic signal.

[Embodiment 3]

Hereinafter, the points same with those described in Embodiment 1 and Embodiment 2 are omitted, and only a different point is described.

Figure 7:
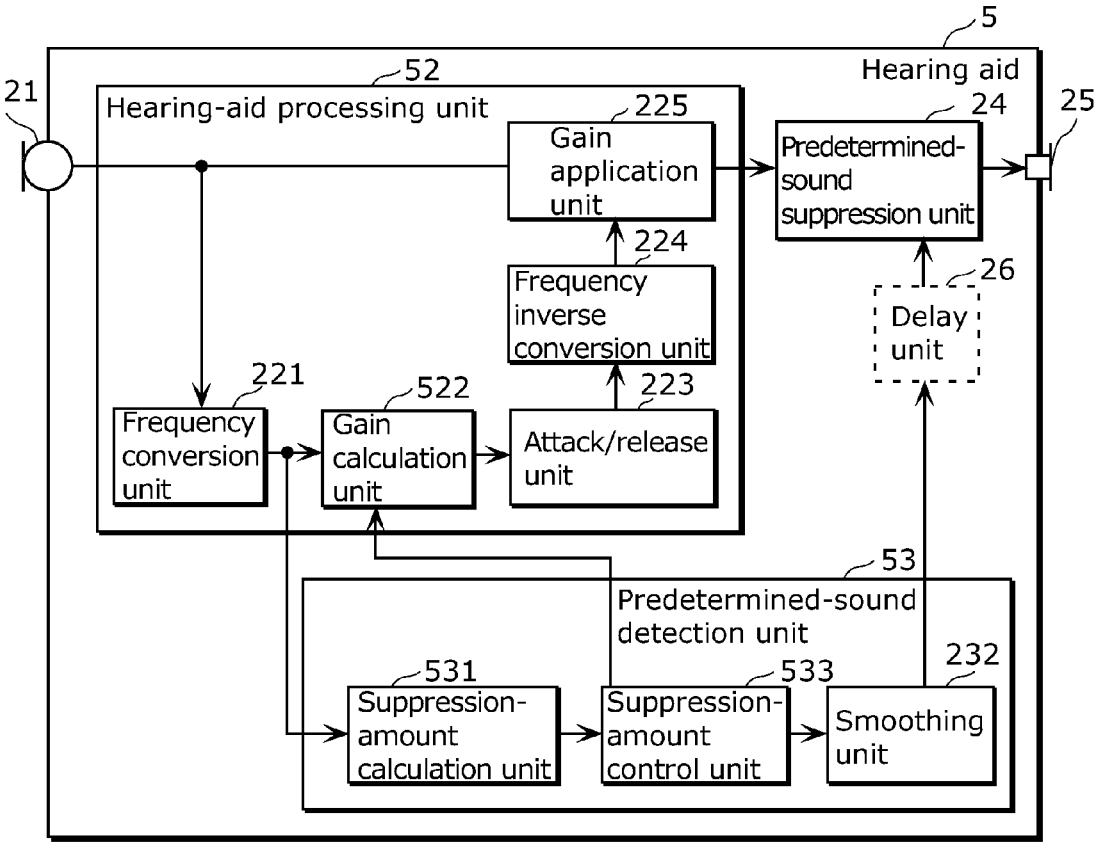
FIG. 7 is a block diagram which shows a hearing aid according to Embodiment 3.

FIG. 7 is a block diagram which shows a hearing aid 5 according to Embodiment 3 of the present invention. A hearing aid 5 according to Embodiment 3 of the present application is described in terms of configuration and operation thereof, with reference to FIG. 7. A basic configuration of the hearing aid 5 is the same with that of the hearing aid 2.

The hearing aid 5 includes a microphone 21, a hearing-aid processing unit 52, a predetermined-sound detection unit 53, a predetermined-sound suppression unit 24, and a speaker 25. It should be noted that the hearing aid 5 may further include the delay unit 26. Hereinafter, the description for the configuration same with those in the hearing aid 4 is omitted, and the hearing-aid processing unit 52 and the predetermined-sound detection unit 53 are described in terms of the configuration and the operation thereof.

The suppression-amount calculation unit 531 in the predetermined-sound detection unit 53 receives the spectrum signal calculated in the frequency conversion unit 221 as an input, and detects the predetermined sound included in the acoustic signal received by the microphone 21, in each of a plurality of bands. Then, the suppression-amount calculation unit 531 calculates a plurality of suppression amounts used for suppressing components in the predetermined sound detected for the respective bands.

The suppression-amount control unit 533 in the predetermined sound detection unit 53 divides the suppression amounts calculated in the suppression-amount calculation unit 531 into a suppression amount to be applied in the hearing-aid processing unit 52 and a suppression amount to be applied in the predetermined-sound suppression unit 24.

The gain calculation unit 522 in the hearing-aid processing unit 52 calculates, from the frequency-converted spectrum signal, the signal power value for each of the bands which are subjected to the control under the hearing-aid processing, and also calculates the control gain according to the ability of the user to hear. Then, the gain calculation unit 522 receives, as a second input, the suppression amounts calculated in the respective suppression-amount calculation unit 531 and the suppression-amount control unit 533 so as to control the control gains for the bands including the respective suppression amounts.

With this configuration, the predetermined sound can be suppressed in the respective processing blocks, such as the hearing-aid processing unit 52 and the predetermined-sound suppression unit 24, having different time response properties. Accordingly, the predetermined sound can be suppressed without preventing the user from recognizing the circumstances.

On the suppression of the predetermined sound, complete removal of the predetermined sound prevents the user from recognizing circumstances, which brings a great danger.

The exponential increase in a sound pressure of the predetermined sound burdens and causes the user to feel uncomfortable. Accordingly, it is desirable that the predetermined sound is suppressed immediately after its generation without delay. On the other hand, the predetermined sound is suppressed, in the same manner as in the immediately after the generation, up to the subsequent zone of the predetermined sound causes the predetermined sound to be completely removed or greatly distorted, which prevents the user from recognizing the circumstances. Therefore, it is desirable that the predetermined sound in the subsequent zone is weakly suppressed, or the predetermined sound in a part of the band is not suppressed.

The achievement of the suppression amount to the predetermined-sound suppression unit 24 in the hearing aid 5 according to Embodiment 3 is not delayed behind the achievement of the acoustic signal including the predetermined sound, so that the predetermined-sound suppression unit 24 can suppress the predetermined sound immediately after the generation thereof without delay. Meanwhile, the hearing-aid processing unit 52 has a certain level of delay property, while capable of performing the processing according to the frequency characteristics of the received acoustic signal and a level of the user's ability to hear. Therefore, the suppression of the predetermined sound cannot be effected immediately after the generation of the predetermined sound, but can be effected in the subsequent zone, so that the predetermined sound can be suppressed in the subsequent zone thereof by the predetermined-sound suppression processing in cooperation with the hearing-aid processing.

For example, the gain calculation unit 522 in the hearing-aid processing unit 52 may suppress the control gain particularly in the band where a level of the control gain significantly varies among the bands where the component of the predetermined sound is detected by the suppression-amount calculation unit 531. With this configuration, only the especially raspy level can be suppressed while a tone of the predetermined sound is kept. The gain calculation unit 522 may not control the control gain around a voice band (1 kHz to 4 kHz) among the bands detected by the suppression-amount calculation unit 531. This reduces damage onto a voice signal which mixedly exists with the predetermined sound.

In order to perform the aforementioned suppression processing on the predetermined sound, the suppression-amount control unit 533 outputs the maximum suppression amount among the suppression amounts calculated in the suppression-amount calculation unit 531 to the smoothing unit 232 as the suppression amount to be applied in the predetermined-sound suppression unit 24. The suppression-amount control unit 533 also outputs the suppression amounts to the gain calculation unit 522.

The suppression-amount control unit 533 may output the minimum suppression amount among the suppression amounts calculated in the suppression-amount calculation unit 531 to the smoothing unit 232 as the suppression amount to be applied in the predetermined-sound suppression unit 24.

When the maximum suppression amount among the suppression amounts calculated in the suppression-amount calculation unit 531 is applied in the predetermined-sound suppression unit 24, the maximum suppression effect can be obtained in the predetermined-sound suppression unit 24. On the other hand, when the minimum suppression-amount is applied in the predetermined-sound suppression unit 24, a possibility can be reduced that the acoustic signal which is not the predetermined sound is erroneously attenuated.

When the sound pressure increases from a silent status, such as a case when the user is talked to in quiet circumstances, it is highly possible that the voice signal is erroneously detected as the predetermined sound. When the maximum suppression amount, even in the entire band or the plural bands, is output to the smoothing unit 232, the voice signal immediately after the generation thereof, i.e., the beginning of words of the talk is attenuated.

However, since the voice signal is a signal outputted by resonation of a vocal tract, it does not vary in a manner as the sound pressure in the entire band increases uniformly. Accordingly, if the components of the predetermined sound are detected for the respective divided bands in the suppression-amount calculation unit 531, a band where a large suppression amount is calculated and a band where a small suppression amount is calculated mixedly exist. Therefore, if the minimum suppression amount among the suppression amounts is applied in the predetermined-sound suppression unit 24, the voice signal is attenuated using the small suppression amount calculated in the band where the increase amount of the sound pressure is small, to thereby decrease the damage to the voice signal.

The suppression-amount control unit 533 may output the suppression amount which is out of the maximum and minimum suppression amounts among the suppression amounts calculated in the suppression-amount calculation unit 531 to the smoothing unit 232 as the suppression amount to be applied in the predetermined-sound suppression unit 24. A suppression amount may be selected from a specified band or specified bands among the suppression amounts calculated in the suppression-amount calculation unit 531, and may be output as the suppression amount to be applied in the predetermined-sound suppression unit 24.

Furthermore, the suppression-amount control unit 533 may control the suppression amounts calculated in the suppression-amount calculation unit 531, and then, output the controlled suppression amounts to the gain calculation unit 522.

Furthermore, the band of the suppression amounts calculated in the suppression-amount calculation unit 531 may be coincident with the band of the signal power value or of the control gain both of which are calculated in the gain calculation unit 522. With this configuration, the band where the predetermined sound is suppressed in the subsequent zone is coincident with the band where hearing-aid processing control is performed, thereby enabling the suppression processing according to the level of the user's ability to hear by the suppression-amount processing in cooperation with the hearing-aid processing. Therefore, the predetermined sound can be suppressed at a level where the user can listen to the predetermined sound.

Furthermore, the suppression-amount control unit 533 may be placed at a subsequent stage of the smoothing unit 232. With this configuration, the suppression amount output to the gain calculation unit 522 is coincident with the suppression amount which is to be applied in the predetermined-sound suppression unit 24, so that switching around a peak amplitude of the predetermined sound can be suppressed more naturally.

As described above, in the hearing aid 5 according to Embodiment 3, the predetermined sound can be suppressed in its rise zone or subsequent zone, respectively by the processing blocks of the predetermined-sound suppression unit 24 and the hearing-aid processing unit 52 having mutually different time response properties. Therefore, the predetermined sound can be suppressed without preventing the user from recognizing the circumstances.

As described above, in the hearing aid according to an embodiment of the present invention, the predetermined sound can be suppressed in the rise zone and the subsequent zone having mutually different properties. Here, the rise zone is the time zone where the amplitude of the predetermined sound drastically varies, while the subsequent zone which is the time zone which is subsequent to the rise zone and continues until the predetermined sound is not observed. Specifically, in the rise zone, the predetermined sound having the great amplitude is suppressed by the predetermined-sound suppression unit, while in the subsequent zone, the predetermined sound is suppressed so as to be gradually distinguished. With this configuration, the predetermined sound can be suppressed without preventing the user from recognizing the circumstances so that the user can naturally recognize the predetermined sound.

In addition, the predetermined sound included in the input sound can be significantly controlled by the predetermined-sound suppression unit.

As a result of the control of the predetermined sound included in the input sound in the predetermined-sound suppression unit, the volume of the predetermined sound can be avoided from being diminished to a level which cannot be recognized by the user.

The frequency band (first frequency band) of the predetermined sound suppressed in the subsequent zone is coincident with the band where the hearing-aid processing control is performed, so that the predetermined sound can be more naturally suppressed.

Furthermore, the predetermined sound can be suppressed without being delayed in the rise zone, to thereby solve the discomfort and the burden imposed on the user. In the subsequent zone, the predetermined sound can be suppressed by the predetermined-sound suppression processing in cooperation with the hearing-aid processing. Therefore, the predetermined sound can be suppressed without preventing the user from recognizing the circumstances.

[Embodiment 4]

Hereinafter, the points same with those described in Embodiment 1 to Embodiment 3 are omitted, and only a different point is described with respect to Embodiment 4.

Figure 8:
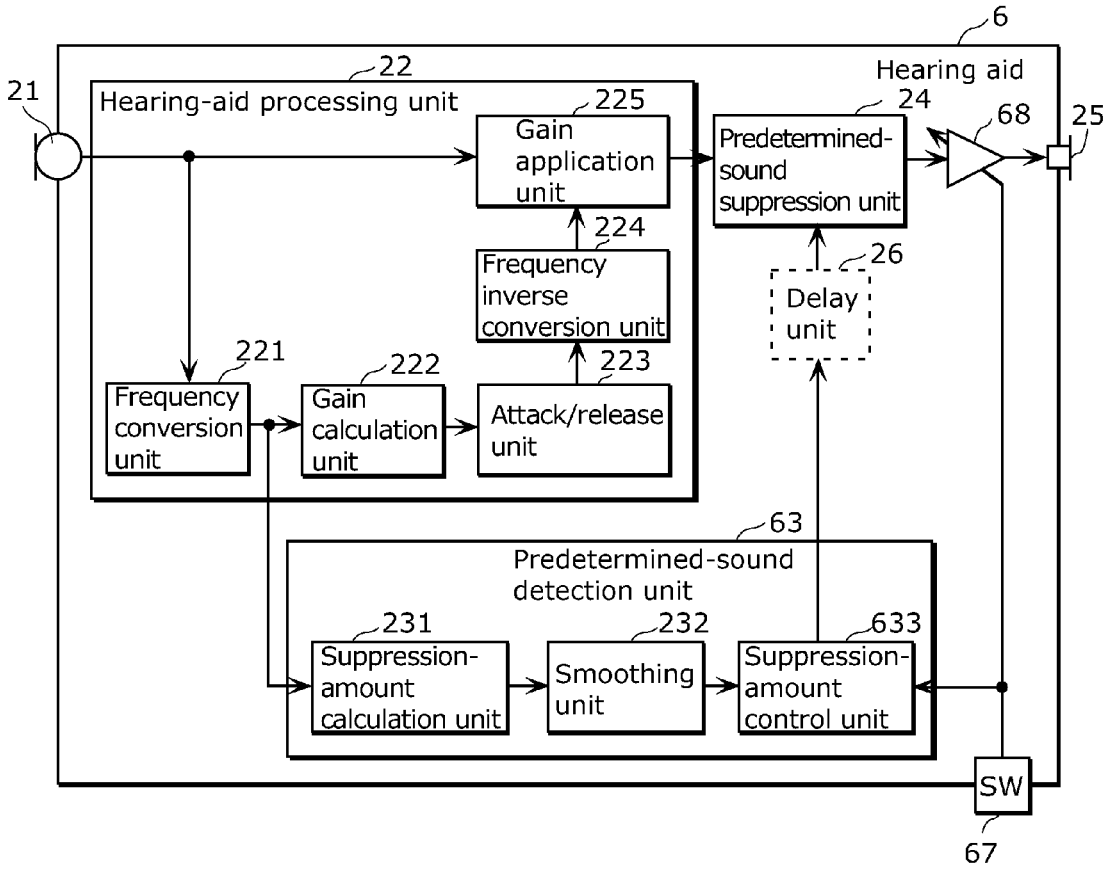
FIG. 8 is a block diagram which shows a hearing aid according to Embodiment 4.

FIG. 8 is a block diagram which shows a hearing aid 6 according to Embodiment 4 of the present invention. A hearing aid 6 according to Embodiment 4 of the present application is described in terms of configuration and operation thereof, with reference to FIG. 8. A basic configuration of the hearing aid 6 is the same with that of the hearing aid 2.

The hearing aid 6 includes the microphone 21, the hearing-aid processing unit 22, a predetermined-sound detection unit 63, the predetermined-sound suppression unit 24, the speaker 25, a volume adjusting switch 67, and a variable gain control unit 68. It should be noted that the hearing aid 6 may further include the delay unit 26. Hereinafter, the description for the components same with those in the hearing aid 2 is omitted, and the predetermined-sound detection unit 63, the volume adjusting switch 67, and the variable gain control unit 68 are described in terms of the configuration and operation thereof.

The volume adjusting switch 67 is an interface to be operated in such a case where the user wants to adjust a level of the output sound according to an environment for the usage. The volume adjusting switch 67 is formed in a shape of, for example, a dial, a switch lever, a button including UP/DOWN, or a touch panel, and the present invention is not limited by the shape of the volume adjusting switch 67. Furthermore, a case in which the switch is operated via equipment, such as a remote controller, connected to the hearing-aid body by wireless or wired is also involved in the present invention. For the description in this specification, every configuration having a function with which a user can adjust a level of the output sound of the hearing aid according to the environment of the usage is collectively referred to as the volume adjusting switch 67.

The variable gain control unit 68 controls the gain of the acoustic signal output from the hearing aid 6 in accordance with the volume adjusting amount input by the user through the volume adjusting switch 67. For example, if the volume adjusting amount input by the user corresponds to a value indicating the maximum volume in the volume adjusting switch 67, the variable gain control unit 68 does not change the gain of the acoustic signal to be output. As the volume adjusting amount decreases, the variable gain control unit 68 controls the gain of the acoustic signal.

The suppression-amount control unit 633 in the predetermined-sound detection unit 63 does not change the suppression amount calculated in the suppression-amount calculation unit 231 and the smoothing unit 232, when the volume adjusting amount input by the user through the volume adjusting switch 67 corresponds to the value indicating the maximum volume in the volume adjusting switch 67. The suppression-amount control unit 633 controls the suppression amount by the amount of the gain of the acoustic signal controlled by the variable gain control unit 68, as the volume adjusting amount decreases.

With this configuration, the suppression amount of the predetermined sound can be controlled in accordance with the volume adjustment amount input by the user. Even when the user listens at a low volume, the predetermined sound can be suppressed without being suppressed to a level lower than or equal to the level of the user's ability to hear, without preventing the user from recognizing the circumstances.

Because of the exponential increase in the sound pressure, the predetermined sound burdens and causes the user to feel uncomfortable, which is resulted not only by the increasing speed of the sound pressure but also by a level thereof itself after completion of the increase of the sound pressure. When the user listens at the low volume through the volume adjusting switch 67, an output sound pressure of the acoustic signal including the predetermined sound is controlled by the variable gain control unit 68. Accordingly, the discomfort degree is reduced even if the predetermined sound is not greatly suppressed in the predetermined-sound suppression unit 24. At this time, the predetermined sound is suppressed using the suppression amount similar to that used in the case where the user listens at the maximum volume, causing the output sound pressure of the predetermined sound to become extremely small. Therefore, if the volume becomes below a volume which the user can recognize, the user cannot recognize the predetermined sound. This makes it impossible for the user to sense the circumstances, which brings a great danger.

If the user control, through the volume adjusting switch 67, the gain of the acoustic signal to be output, the suppression amount is controlled by the amount of the controlled gain, to thereby allow the output sound pressure of the suppressed pedetermined sound to be constant. Accordingly, even when the user listens at the low volume, the predetermined sound can be suppressed without turning down the volume below the level which can be recognized by the user.

The suppression amount control unit 633 may have a value smaller than the value which indicates the maximum volume in the volume adjusting switch 67 as a reference value. With this configuration, when the volume adjustment amount input by the user through the volume adjusting switch 67 is more than or equal to the reference value, the suppression amount calculated in the suppression-amount calculation unit 231 and the smoothing unit 232 is not varied, and the suppression amount may be controlled by the amount of the gain, of the acoustic signal, controlled below the reference value in the variable gain control unit 68, as the volume adjusting amount decreases. With this configuration, a set volume, of the volume adjusting switch 67, where the output sound pressure of the suppressed predetermined sound is constant, is decreased to alleviate the control amount of the suppression amount, so that insufficient suppression of the predetermined sound when the user listens at the low volume can be solved.

Figure 9:
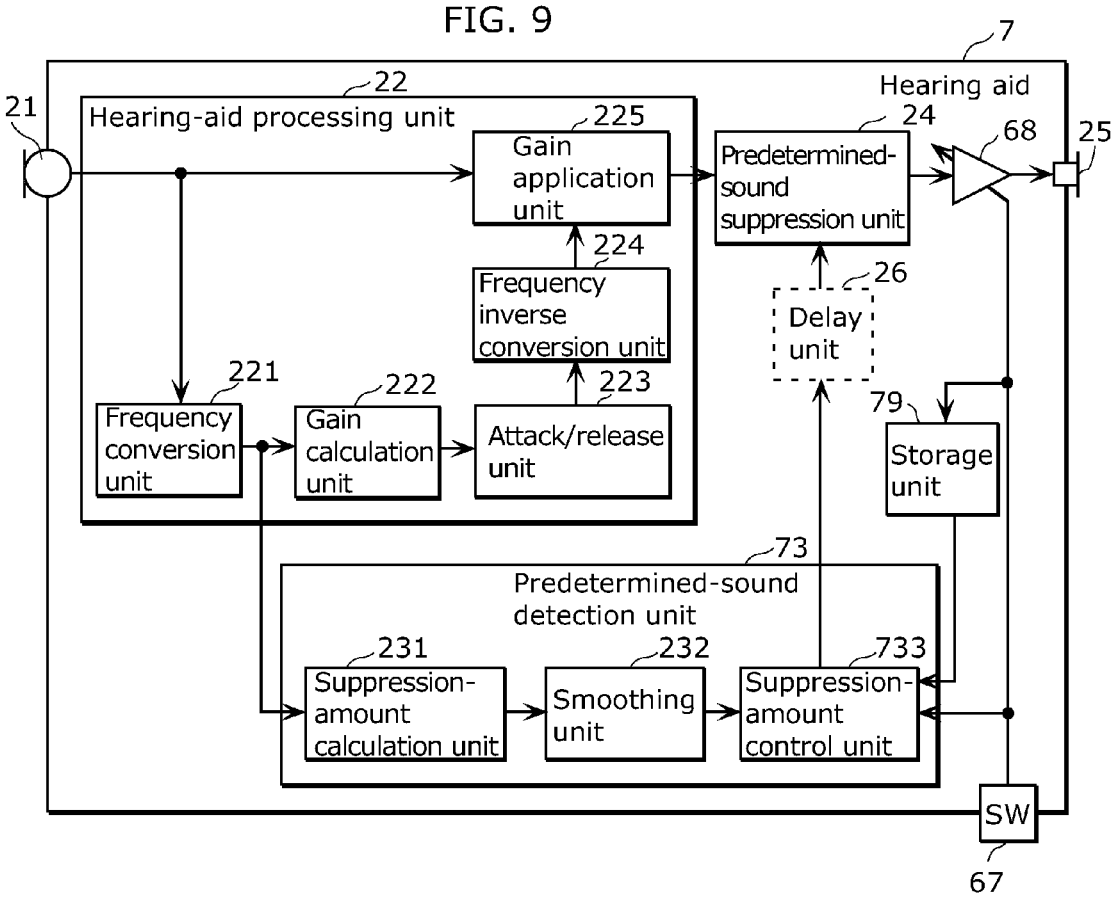
FIG. 9 is a block diagram which shows another aspect of the hearing aid according to Embodiment 4.

As a hearing aid 7 shown in FIG. 9, the hearing aid may include a storage unit 79 which records an operation history of the user.

The storage unit 79 records a history of the volume adjusting amount input by the user through the volume adjusting switch 67.

A suppression-amount control unit 733 in the predetermined-sound detection unit 73 allows the volume adjustment amount which the user usually uses to be the aforementioned reference value from the history of the volume adjustment amount which is input by the user in the past and recorded in the storage unit 79.

With this configuration, the output sound pressure of the predetermined sound which the user listens to on usual usage can be kept when the user listens at the low volume.

As described above, in the hearing aid according to an embodiment of the present invention, when the user listens at the low volume, the predetermined sound can be suppressed within a range which is not below the volume the user can recognize. On the other hand, when the user listens at the large volume, the predetermined sound can be controlled so as not to be extremely amplified by the hearing-aid processing.

The output sound pressure of the suppressed predetermined sound can be made constant.

From the history recorded in the storage unit, the output sound pressure of the predetermined sound which the user listens to on the usual usage can be obtained. Even when the user listens at the low volume for any reason, the user can listen to the predetermined sound with the output volume same with that on the usual usage.

[Modifications]

Although the present invention is described in accordance with the aforementioned embodiments, the present invention is not limited to the above embodiments. The present invention also includes following cases.

(1) A part of or all of components constituting the aforementioned respective devices may be formed, specifically, as a computer system including a microprocessor, a ROM, a RAM, a hard disc unit, and the like. The RAM or the hard disc unit stores a computer program which accomplishes operations same with those achieved by the aforementioned respective devices. The microprocessor operates in accordance with the computer program, so that the computer system accomplishes its function.

(2) A part or all of the components constituting each of the above devices may be configured by a single system-LSI (large-scale integration). The system-LSI is a super multi-function LSI manufactured by integrating a plurality of constituent units on a single chip, and is, specifically, a computer system including a microprocessor, a ROM, a RAM, and so on. The RAM stores a computer program which accomplishes the operations same with those achieved by the aforementioned respective devices. The microprocessor operates in accordance with the computer program, so that the system-LSI accomplishes its function.

(3) A part or all of the components constituting each of the devices may be configured as an IC card which is detachable from each of the devices or a single module. The IC card or the module is a computer system including a microprocessor, a ROM, a RAM, and so on. The IC card or the module may include the aforementioned system-LSI. The microprocessor operates in accordance with the computer program, so that the IC card or the module accomplishes its function. The IC card or the module may have tamper resistance.

(4) The present invention may be in the form of a method which is realized by the processing of the computer indicated above. The present invention may also be a computer program which realizes the method by a computer, or may be a digital signal including the computer program.

The present invention may be realized by storing the computer program or the digital signal in a computer readable recording medium, such as a flexible disc, a hard disc, a CD-ROM, an MO, a DVD, a DVD-ROM, a DVD-RAM, a Blu-ray disc (BD), or a semiconductor memory. Alternatively, the present invention may also include the digital signal recorded in these recording media.

The present invention may also be realized by transmission of the aforementioned computer program or digital signal via an electric telecommunication line, a wireless or wired communication line, a network represented by the Internet, a data broadcast, and so on.

The present invention may also be a computer system including a microprocessor and a memory, in which the memory stores a computer program, and the microprocessor operates in accordance with the computer program.

Furthermore, the computer program or the digital signal may be stored in the recording medium so as to be transferred, or the computer program or the digital signal may be transferred via the network or the like so as to be executed by another independent computer system.

(5) The above embodiments and modifications may be combined arbitrarily.

INDUSTRIAL APPLICABILITY

As described above, in a hearing aid and a method of controlling the hearing aid according to the present invention, an acoustic signal is not required to be delayed for compensating a time period for detecting a predetermined sound, to thereby suppress the predetermined sound while keeping a delay property generated during hearing-aid processing. Therefore, the present invention is useful for a hearing aid equipped with a predetermined-sound suppression function.

REFERENCE SIGNS LIST

1, 2, 3, 4, 5, 6, and 7 Hearing aid
11, 21 Microphone
12, 22, 32, 42, and 52 Hearing-aid processing unit
13, 23, 43, 53, 63, and 73 Predetermined-sound detection unit
14, 24 Predetermined-sound suppression unit
15, 25 Speaker
16, 26, and 1001 Delay unit
67 Volume adjusting switch
68 Variable gain control unit
79 Storage unit
221 Frequency conversion unit
222, 522 Gain calculation unit
223 Attack/release unit
224, 326 Inverse frequency conversion unit
225, 325 Gain application unit
231, 431, and 531 Suppression-amount calculation unit
232 Smoothing unit
533, 633, and 733 Suppression-amount control unit

The invention claimed is:

1. A hearing aid comprising a hardware processor, the hardware processor being configured to:

produce a spectrum signal which indicates a frequency component included in a first acoustic signal received by a microphone;

calculate, using the spectrum signal, a control gain value;

amplify the first acoustic signal using the control gain value to produce the second acoustic signal;

detect a predetermined sound in the first acoustic signal from the spectrum signal, the predetermined sound occurring abruptly;

produce a plurality of control signals, each of which indicates a corresponding one of suppression amounts each of which is allocated to a corresponding one of a plurality of frequency components in the predetermined sound in the first acoustic signal;

apply at least one of the control signals to the second acoustic signal to attenuate the predetermined sound in the second acoustic signal;

output at least one of the control signals; and control the control gain value calculated using the spectrum signal, using a calculation based on the at least one of the outputted control signals, wherein the hearing aid further comprises:

a volume adjusting switch for a user to input a volume adjusting amount for adjusting a volume of an output sound signal of the hearing aid; and a variable gain controller to control a gain value according to the input volume adjusting amount, the gain value being applied to the second acoustic signal to adjust the volume of the output sound signal, and wherein the hardware processor is further configured to:

increase or decrease the at least one of the control signals applied to the second acoustic signal based on a difference between the adjusted volume of the output sound signal and a predetermined reference value, when the adjusted volume of the output sound signal is lower than the predetermined reference value.

2. The hearing aid according to claim 1, wherein the hardware processor is further configured to delay the at least one of the control signals applied to the second acoustic signal by a time difference between first time and second time, wherein the first time is required for amplifying the first acoustic signal, and wherein the second time is required for detecting the predetermined sound.

3. The hearing aid according to claim 1, wherein the hardware processor is further configured to output at least one of the control signals which includes a control signal having a minimum suppression amount among the suppression amounts each of which is allocated to the corresponding one of the frequencies included in the control signals.

4. The hearing aid according to claim 1, wherein the hardware processor is further configured to output at least one of the control signals which includes a control signal having a maximum suppression amount among the suppression amounts each of which is allocated to the corresponding one of the frequencies included in the control signals.

5. The hearing aid according to claim 1, wherein the one of the plurality of frequency components is included in a first frequency band in the predetermined sound in the first acoustic signal, and the control gain value calculated using the spectrum signal is included in the first frequency band.

6. The hearing aid according to claim 1, wherein the hardware processor is further configured to:

suppress the predetermined sound in a rise zone which is a time zone where an amplitude of the predetermined sound drastically varies;

keep the control gain value in the rise zone; and control the control gain value based on the at least one of the outputted control signals in a subsequent zone which is a time zone after the rise zone until the predetermined sound being no longer observed.

7. The hearing aid according to claim 1, wherein the predetermined reference value is a maximum volume of the output sound signal which can be adjusted by the volume adjusting switch.

8. The hearing aid according to claim 7, further comprising storage configured to record a history of the volume adjustment amount adjusted by the volume adjusting switch, wherein the reference value is determined based on the history of the volume adjustment amount recorded in the storage.

9. A method for controlling a hearing aid including a hardware processor, the method comprising:

producing a spectrum signal which indicates a frequency component included in a first acoustic signal received by a microphone;

calculating, using the spectrum signal, a control gain value;

amplifying the first acoustic signal using the control gain value to produce the second acoustic signal;

detecting a predetermined sound in the first acoustic signal from the spectrum signal, the predetermined sound occurring abruptly;

producing a plurality of control signals, each of which indicates a corresponding one of suppression amounts each of which is allocated to a corresponding one of a plurality of frequency components in the predetermined sound in the first acoustic signal;

applying at least one of the control signals to the second acoustic signal to attenuate the predetermined sound in the second acoustic signal;

outputting at least one of the control signals; and controlling the control gain value calculated using the spectrum signal, using a calculation based on the at least one of the control signals output in said outputting, receiving a volume adjusting amount for adjusting a volume of an output sound signal of the hearing aid;

controlling a gain value according to the input volume adjusting amount, the gain value being applied to the second acoustic signal to adjust the volume of the output sound signal; and increasing or decreasing the at least one of the control signals applied to the second acoustic signal in said applying based on a difference between the adjusted volume of the output sound signal and a predetermined reference value, when the adjusted volume of the output sound signal is lower than the predetermined reference value.

10. The hearing aid according to claim 1, wherein the hardware processor is further configured to calculate a suppression amount based on the predetermined sound in the first acoustic signal, and the suppression amount is used to attenuate the predetermined sound in the second acoustic signal.

11. The hearing aid according to claim 1, wherein the control gain value indicates, for each of a plurality of frequencies, an amount of amplification of the first acoustic signal, according to an ability of a user to hear sound in each of the plurality of frequencies.

* * * * *